US011407128B1

(12) United States Patent
Panosian et al.

(10) Patent No.: US 11,407,128 B1
(45) Date of Patent: Aug. 9, 2022

(54) UTILITY KNIFE WITH REPLACEABLE BLADES AND RELOADABLE BLADE MAGAZINE

(71) Applicants: Michael H. Panosian, Irvine, CA (US); Joshua M. Keeler, Irvine, CA (US)

(72) Inventors: Michael H. Panosian, Irvine, CA (US); Joshua M. Keeler, Irvine, CA (US)

( * ) Notice: Subject to any disclaimer, the term of this patent is extended or adjusted under 35 U.S.C. 154(b) by 0 days.

(21) Appl. No.: 17/319,108

(22) Filed: May 13, 2021

(51) Int. Cl.
*B26B 5/00* (2006.01)

(52) U.S. Cl.
CPC ..... *B26B 5/003* (2013.01); *B26B 5/006* (2013.01)

(58) Field of Classification Search
None
See application file for complete search history.

(56) References Cited

U.S. PATENT DOCUMENTS 4,277,888 A * 7/1981 Szabo ..... B26B 5/002 30/162
5,960,545 A * 10/1999 Shepherd ..... B26B 5/001 30/125
6,330,749 B1 * 12/2001 Khachatoorian ..... B26B 5/001 30/125
6,357,120 B1 * 3/2002 Khachatoorian ..... B26B 5/001 30/162
6,415,514 B1 * 7/2002 Chun ..... B26B 5/001 30/162
7,418,784 B2 * 9/2008 Fossella ..... B26B 5/001 30/162
2007/0220758 A1 * 9/2007 Ho ..... B26B 5/001 30/162
2011/0041344 A1 * 2/2011 De ..... B26B 5/001 30/162
2011/0119928 A1 * 5/2011 Constantine ..... B26B 5/001 30/162
2020/0391396 A1 * 12/2020 Fossella ..... B26B 1/08

* cited by examiner

*Primary Examiner* — Hwei-Siu C Payer
(74) *Attorney, Agent, or Firm* — Farjam Majd; Arjomand Law Group

(57) ABSTRACT

A device is disclosed including a reloadable utility knife having a blade magazine with one or more compartments for storing multiple cutting blades. The blade magazine has a reloading compartment for new blades, and a storage compartment to keep additional blades. The blade magazine is loaded from the rear of the knife body and is locked inside. A working blade may be released before reloaded a fresh blade. The working blade can be extended or retracted multiple times via a blade transport mechanism. The blade magazine may be extracted via the lock mechanism and pushed out by a spring designed for this purpose. The blade transport mechanism, the blade release mechanism, and a blade lock mechanism work in cooperation to allow extension and retraction of a blade, disposing of a blade, and reloading of a blade.

6 Claims, 9 Drawing Sheets

UTILITY KNIFE WITH REPLACEABLE BLADES AND RELOADABLE BLADE MAGAZINE

CROSS-REFERENCE(S) TO RELATED APPLICATION(S)

None.

TECHNICAL FIELD

This application relates generally to utility knives and box cutters. More specifically, this application relates to a utility knife with retractable and replaceable blades and a reloadable magazine.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
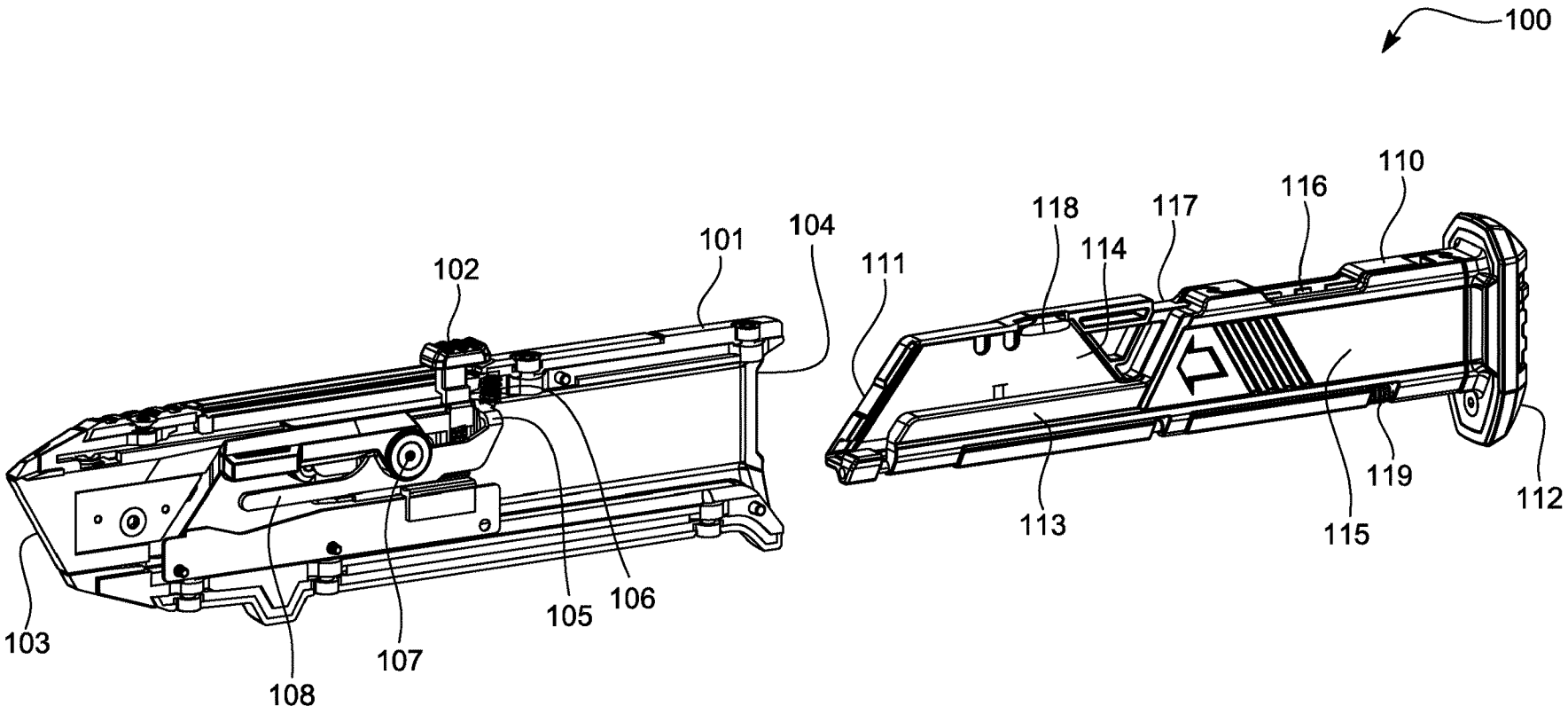
FIG. 1 shows an example reloadable knife body with an uninserted blade magazine.

While the present disclosure is described with reference to several illustrative embodiments and example devices described herein, it should be clear that the present disclosure should not be limited to such embodiments. Therefore, the description of the embodiments provided herein is illustrative of the present disclosure and should not limit the scope of the disclosure as claimed. In addition, while following description references particular configurations of blade magazine, it will be appreciated that the disclosure may be applicable with other types of blade magazine configurations.

Briefly described, a system and a method are disclosed including a reloadable utility knife, such as a box cutter, a construction contractor's knife, a carpet layer's knife, and the like, having a blade magazine with one or more compartments for storing multiple cutting blades, which can be loaded into the knife one-by-one by the user. The blade magazine allows providing fresh blades to the knife without any disassembly of the knife body to insert blades for use. In some embodiments, the magazine has a reloading or operating compartment for supplying new blades to the reloadable knife, and a storage compartment to keep additional blades on hand for quick deployment. The blades may be kept securely in the compartments by the aid of compartment springs and a blade retention lip on the reloading compartment. In some embodiments, the blade magazine is loaded into the knife from the rear of the body (opposite the tip of the knife where blade is extended for use) and is locked securely in place until extracted. A used working blade may be released by the user using a release mechanism before reloading a fresh blade. The same working blade can be extended or retracted multiple times via a blade transport mechanism before it is disposed. The blade magazine may be extracted via the lock mechanism and pushed out by a spring designed for this purpose. The blade transport mechanism (or blade carriage), the blade release mechanism, and a blade lock mechanism work in cooperation to allow extension and retraction of a blade, disposing of a blade, and reloading of a blade. In some embodiments, the blade magazine may be double-ended to be inserted into the knife body from either end of the blade magazine. In other embodiments, the blade itself may be turned around without releasing the blade from knife body, so the unused end of the blade may be used. This way, the blade life is doubled.

In various embodiments, the reloadable utility knife may include a hollow knife body having a front end and a back end. A back entry at the back end of the of the knife body may be used to receive the blade magazine, which may include a blade reloading compartment to contain multiple blades. The reloading compartment may also include a blade retention lip to keep the blades inside the blade reloading compartment. A blade carriage may also be deployed within the knife body to engage a working blade from the blade magazine to slide out the working blade for use or retract it for storage. A blade release button may be used to release the working blade when the blade release button is pressed or actuated.

In various embodiments, the reloadable utility knife may include a hollow knife body having a front end and a back end. A back entry at the back end of the of the knife body to receive a blade magazine, which may in turn include a blade compartment to contain multiple blades. A blade carriage may also be deployed within the knife body to engage a working blade from the blade magazine. The blade carriage may also include a blade attachment subassembly having a magnet deployed thereon. A blade magazine lock may also be employed that includes a lock lever to lock the blade magazine inside the knife body and a lock handle to release the blade magazine from the knife body.

In various embodiments, the blade magazine may include at least one blade reloading compartment to receive multiple blades. A blade retention lip may be coupled with the blade reloading compartment. A blade retention spring may be deployed within the blade reloading compartment to push the blades against the blade retention lip to keep the blades within the blade reloading compartment. A partial lid may also be used to partially cover the blades within the blade reloading compartment and prevent the blades from falling out from the blade reloading compartment.

Building contractors, construction crews, carpet layers, private do-it-yourself (DIY) people, shipping operations and warehouses that use cutting instruments, often use utility knives, sometimes referred to as box cutters. Most utility knives on the market have a single operating blade. Some have a storage compartment inside the knife's body for quicker and ready access to new and sharp blades. Most existing utility knives may need to be disassembled to some extent to access the blades inside for replacement. Disassembly in this context means having to open the body or handle of the knife, usually fastened together with a screw, to change the blades.

Disassembly of the knife body or handle can be a time-consuming and cumbersome process, especially when a contractor is working on a project that has time constraints. Speed and efficiency can improve project performance. Additionally, there are different types of blade tips for different tasks. These blade types include hook, scalloped edge, serrated edge, pointed tip, rounded tip, and the like, and are used for different applications. A user may also want to quickly switch between blades types to perform different tasks. Therefore, there is a need for a flexible utility knife that allows quick blade changes, both to use new blades and to use a different type of blade, to reduce project costs and increase overall efficiency and quality.

FIG. 1 shows an example reloadable knife body with an uninserted blade magazine. In various embodiments, the reloadable knife 100 includes a knife handle or body 101 having a front end 103 and a back end 104, a blade carriage slider button 102, a magazine lock including a lock lever 105 that rotates around pivot point 107, a lock handle 108, and a lock spring 106. The reloadable knife 100 further includes a blade magazine 110 having a front end 111 and a back end 112, a blade storage compartment lid 115 covering stored blades 116 in the storage blade compartment, a storage compartment lid spring 119, a magazine lock notch 117, reloadable blades 114 retained by blade retention lip 118, and a blade reloading compartment partial lid 113.

In various embodiments, the knife body 101 (also referred to as handle) includes a hollow shell that includes structures and mechanical components or mechanisms to support receiving one or more cutting blades 114 and deploy the blade for using in cutting objects, such as cardboards, plastic sheets, strings and other similar thin and soft objects, by pushing it forward to extend outside the front end 103 of the knife body and also be retracted back into the body for safety and storage. The knife body further includes a cavity to receive the blade magazine 110 and lock it in to prevent accidental retraction or falling out of the blade magazine 110. The magazine lock is used to lock in the blade magazine 110 when the blade magazine is inserted into the knife body 101 from an entry located at the back end 104 of the knife body in an insertion operation. During the insertion operation, the lock lever 105 falls into notch 117 of the blade magazine 110, as further described below with respect to FIGS. 2A-2C.

In some embodiments, the knife body 101 may be manufactured by casting metals, such as aluminum, while in other embodiments, it may be made by molding hard plastic. In still other embodiments, the knife body 101 may be machined from a solid piece of metal, hard plastic or other machinable material.

In various embodiments, the knife body further includes a blade release mechanism for discarding a used or dull blade and replacing it with a fresh or sharp blade in a release and reload operation, described below with respect to FIGS. 3, 4, and 5.

In various embodiments, the knife body further includes a blade reload mechanism for discarding a used or dull blade and replacing it with a fresh or sharp blade in the release and reload operation, described below with respect to FIGS. 3, 4, and 5.

In various embodiments, the knife body further includes a blade magazine release mechanism for retracting a blade magazine to reload it with a number of blades or with different types of blades, or to replace it with another ready blade magazine. The blade magazine release operation is described below with respect to FIGS. 3, 4, and 5.

In various embodiments, the blade magazine 110 includes one or more blade compartments. For example, the blade magazine 110 may have a blade operating or reloading compartment in the front end 111 of the blade magazine 110 to hold blades 114 ready to replace the current working blade, which is the blade that can be extended out of the knife body for work or retracted for storage. The blade magazine 110 may also include a blade storage compartment with lid 115 and spring 119 next to the back end 112 of the blade magazine 110 to hold backup or stored blades 116. Spring 119 is used to keep the storage compartment lid 115 closed to secure stored blades. The reloading compartment may include a retention lip 118 to keep blades 114 in place until they are ready to be deployed to replace the current operating (or working) blade.

In various embodiments, the notch 117 may be formed on a top surface of the blade magazine 110 to receive the lock lever 105 of the magazine lock. The top surface of the blade magazine 110, as well as a top surface of the knife body 101, are defined as the surfaces located in a direction opposite from the cutting edge of the blade 114 when it is extended out for use, as shown in FIG. 1. When the magazine is being inserted into the knife body 101 from the back end 104 of knife body, the lock lever 105 is pushed up towards the blade carriage slider button 102, and when the notch 117 arrives at the position of the lock lever 5, the lock lever 105 is pushed into the notch 117 by the lock spring 106, locking the blade magazine 110 inside the knife body 101. At this point, the blade magazine 110 cannot fall out or be extracted from the knife body 101 without the user depressing the lock handle 108 downwards to lift the lock lever 105 around the pivot point 107, releasing the blade magazine for extraction. The lock spring 106 may be any suitable type of spring, such as spiral spring, helical springs, leaf spring, conical and volute springs, disc or Belleville springs, and the like. Other springs employed in the knife body 101 or in the blade magazine 110 for any purpose may similarly be implemented using various suitable types of springs. Furthermore, depending on feasibility or other design constraints, different types of springs may be used for different functions in the reloadable knife body and magazine In various embodiments, the blade magazine 110 may be locked into the knife body 101 using lock and release mechanisms other than the lock lever 105 and lock handle 108, respectively. For example, a button, a slider, a knob, a pin, a half-turn screw, or other similar mechanisms (not shown in figure) may be used to lock and release the blade magazine 110. These lock and release mechanisms may be spring-loaded as appropriate.

In various embodiments, the blade storage compartment lid 115 may be spring-loaded using a spiral spring 119 to push it towards the front end 111 of the blade magazine 110. The blade storage compartment lid fully covers the blade storage compartment and completely encloses any blades inside. To open the lid, the user may use fingers on one hand to slide the lid backwards towards the back end 112 of the blade magazine 110 to clear a latch holding the lid closed and open the lid and expose the storage compartment and the blades inside. Other mechanisms may be used to open the lid such as flipping it open by using a latch on top of the blade magazine 110 that is holding the lid closed.

Those skilled in the art will appreciate that the mechanical mechanisms and devices disclosed herein, such as locks, compartments, blade carriage, and the like, and parts of such mechanisms, such as the blade magazine lock lever and lock handle, blade release button, blade carriage slider button, and the like may be implemented in other ways in various embodiments, without departing from the spirit of the present disclosures. For example, various buttons of a functional mechanism disclosed herein may be implemented in the form of levers, small knobs, handles, tabs, fingers, sliders, and other similar mechanical techniques, inputs, or actuators of a mechanism to cause a change or action to occur in or by the mechanism.

Figure 2A:
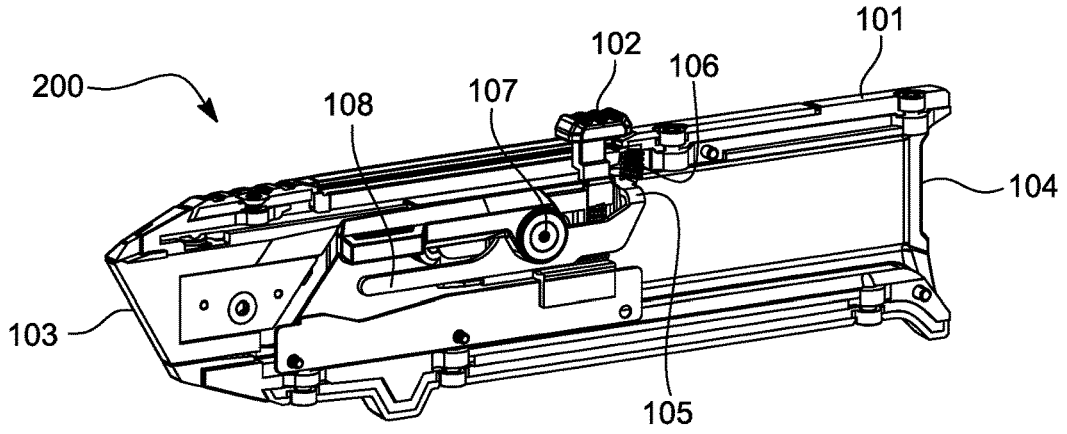
FIG. 2A shows the example reloadable knife body of FIG. 1 including some internal details.

FIG. 2A shows the example reloadable knife body of FIG. 1 including some internal details. In various embodiments, the arrangement 200 may include the knife body 101 having the front end 103 and the back end 104, the blade carriage slider button 102, the magazine lock including the lock lever 105 that rotates around pivot point 107, the lock handle 108, and the lock spring 106.

In various embodiments, the knife body 101 may be hollow to receive the blade magazine 110 via the back end 104. Different blade magazines 110 holding different types of blades may be used to quickly and easily replace blades in the reloadable knife. For example, a blade magazine may hold pointed tip blades, while another blade magazine may hold hook blades. The user may quickly extract one blade magazine and replace it with the other one without having to disassemble or open the knife body 101.

Figure 2B:
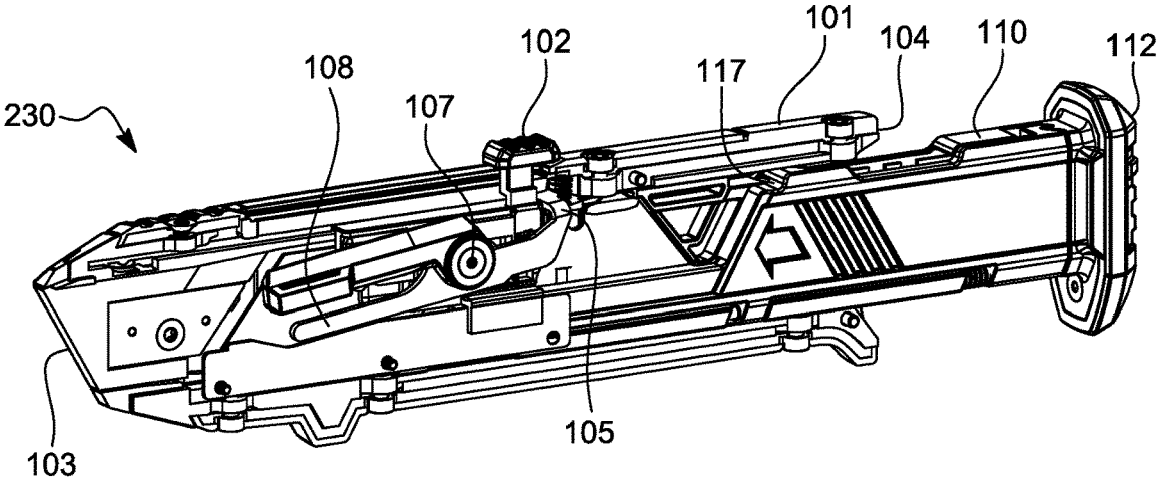
FIG. 2B shows the example reloadable knife body of FIG. 2A with the blade magazine partially inserted and engaging a magazine lock.

FIG. 2B shows the example reloadable knife body of FIG. 2A with the blade magazine partially inserted and engaging a magazine lock. In various embodiments, the arrangement 230 shows the blade magazine 110 partially inserted into the knife body 101 via the opening in the back end 104 of the knife body 101. In this arrangement, the font end of the blade magazine 110 slopes upwards, meaning the front end 111 starts at the bottom surface of the blade magazine and slopes backwards and upwards towards the top surface of the blade magazine. This slopes acts as a wedge to push the lock lever 105 upwards when the blade magazine 110 is pushed forward into the knife body 101. In this figure, the blade magazine is shown as partially inserted into the knife body 101 to the extent that the front end 111 of the blade magazine has just engaged the lock lever 105 and has pushed it upwards to be positioned to fall into the notch 117. This is further signified by lock lever 105 being shown as sloping upwards from the pivot 107 while the lock handle 108 is sloping downwards with respect to the pivot 107.

Figure 2C:
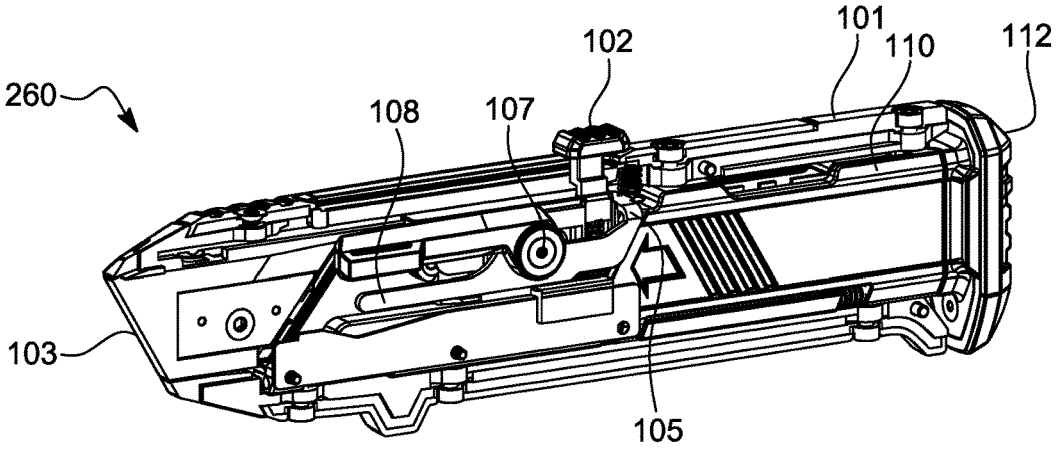
FIG. 2C shows the example reloadable knife body of FIG. 2B with the blade magazine fully inserted and locked in place.

FIG. 2C shows the example reloadable knife body of FIG. 2B with the blade magazine fully inserted and locked in place. In various embodiments, arrangement 260 shows the lock lever 105 and lock handle 108 returned to a horizontal position (parallel with the top and/or bottom surfaces of the blade magazine 110 and/or the knife body 101.) In this position, the blade magazine 110 is fully inserted into the knife body 101 and the magazine lock is fully engaged because the lock lever 105 has been pushed into the notch 117 by the force of lock spring 106, thus, keeping the blade magazine secure. At this point, the reloadable knife is ready for use and the blade may be extended out, retracted, or replaced, as further described below.

Figure 2D:
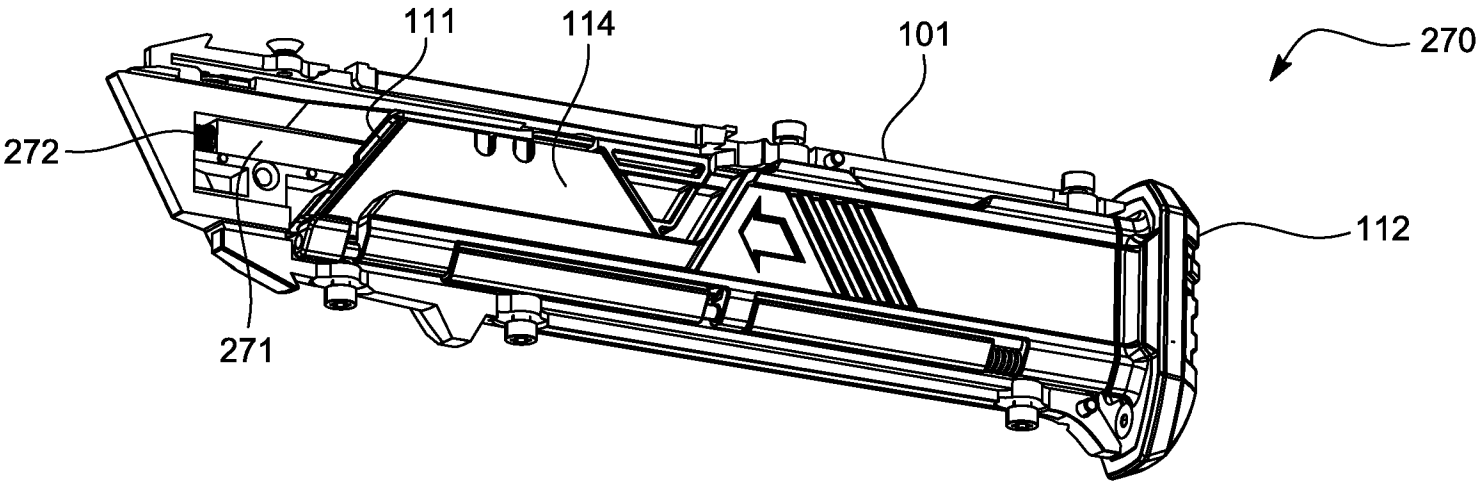
FIG. 2D shows the example reloadable knife of FIG. 2C with blade magazine fully inserted and a magazine extraction spring.

FIG. 2D shows the example reloadable knife of FIG. 2C with blade magazine fully inserted and a magazine extraction spring. In various embodiments, the reloadable knife arrangement 270 includes knife body 101, blade magazine front end 111, blade magazine back end 112, blade 114, magazine extraction plunger 271, and magazine extraction spring 272.

In various embodiments, when the blade magazine 110 (see FIG. 1) is inserted into knife body 101, it is locked in by the magazine lock lever 105. When the blade magazine 110 is extracted by the user, magazine extraction spring 272 assists in the extraction operation by pushing the blade magazine 110 out towards the backend 104 of knife body 101. This spring-assisted motion partially pushes the blade magazine 110 out so the user can easily grab the back end 112 of the blade magazine 110 and extract it.

In various embodiments, the magazine extraction spring 272 is coupled with the front end 111 of the blade magazine 110 via the magazine extraction plunger 271 to create a more secure and mechanically stable coupling to the blade magazine 110 when pushing against it, compared with using a spring alone. Depending on the type of spring, the coupling to the blade magazine front end 111 may have different levels of stability. For example, a longer spiral spring may buckle under applied spring force, if the spring is sufficiently long, while pushing against the blade magazine 110. Under these circumstances, the plunger, which is rigid and may enclose the spring, provides mechanical stability by preventing buckling of the spring. In other embodiments, the magazine extraction spring may be of a different type such as a leaf spring, which does not buckle and may be coupled with the front end 111 of the blade magazine 110 directly.

In various embodiments, the magazine extraction spring 272 may be coupled to or embedded within a receiving cavity or other similar receptacle in the casting of the knife body 101 from inside to provide a physical stop for spring to securely push against the blade magazine 110 when loaded into knife body 101.

Figure 2E:
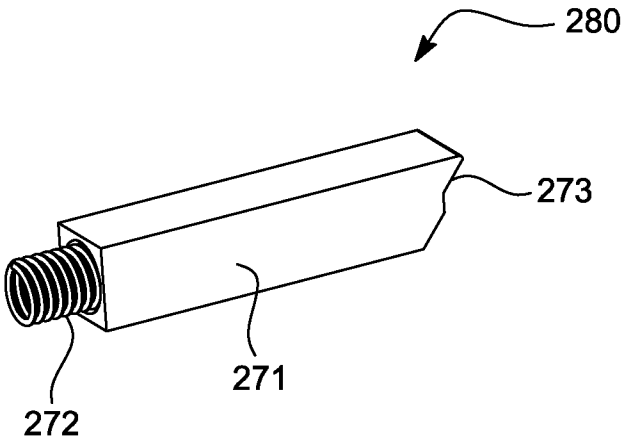
FIG. 2E shows an example magazine extraction spring and plunger.

FIG. 2E shows an example magazine extraction spring and plunger. In various embodiments, magazine extraction assist assembly 280 may include the magazine extraction plunger 271, magazine extraction spring 272, and plunger front end 273.

In various embodiments, the magazine extraction plunger 271 may have a receiving cavity at a back end to receive the magazine extraction spring 272, as shown in the figure. The plunger, being a rigid body, prevents the spring from buckling or other mechanical instability by enclosing it. The plunger front end 273 may be designed to conform to the shape of the front end 111 of the blade magazine 110 to securely engage the front end when the magazine is fully inserted into the knife body 101. In some embodiments, the contours of plunger front end 273 may be formed to closely match the contours of the front end 111 of the blade magazine 110.

Figure 3B:
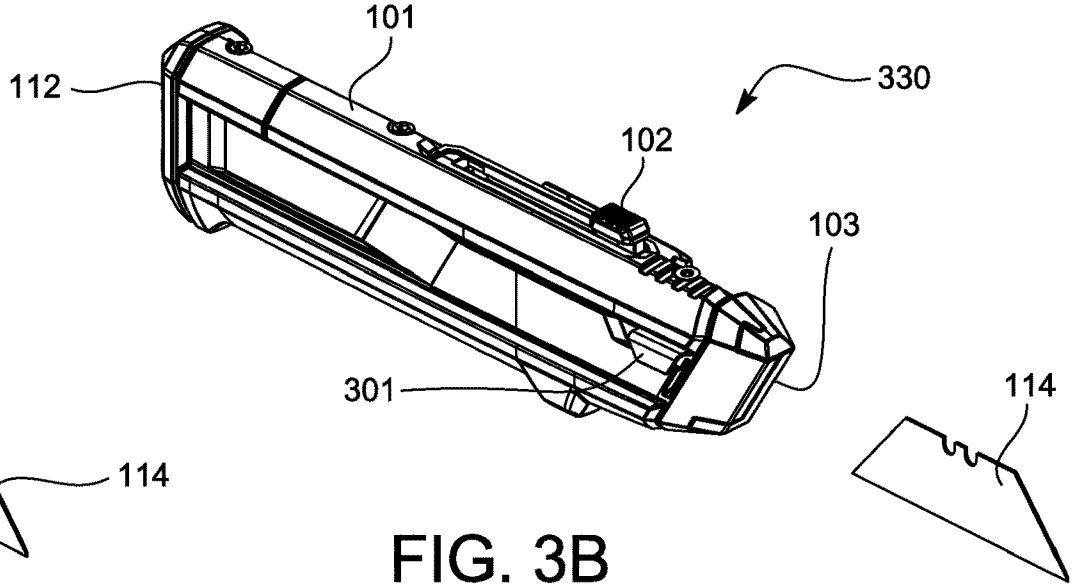
FIG. 3B shows an example reloadable knife with a released blade using a release mechanism.
Figure 3C:
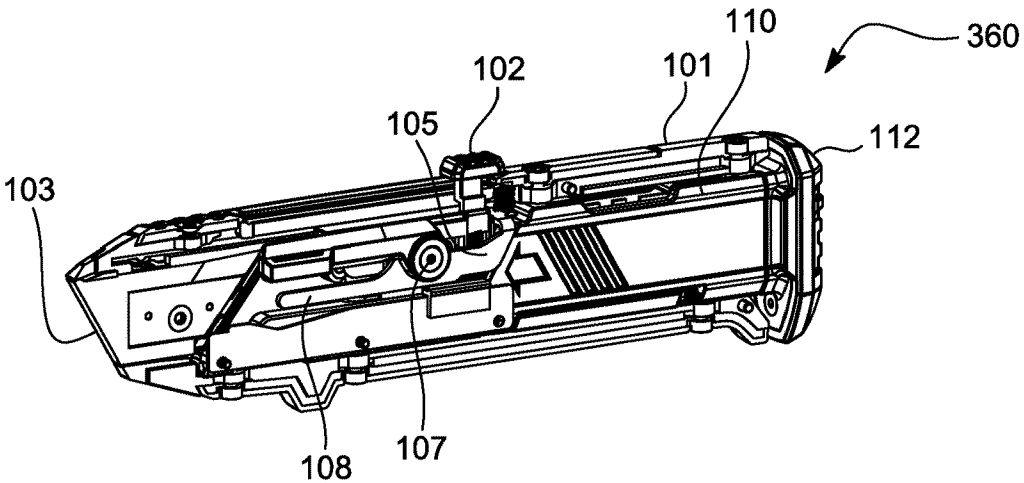
FIG. 3C shows the example reloadable knife of FIG. 6 in a state to reload a new blade.
Figure 3A:
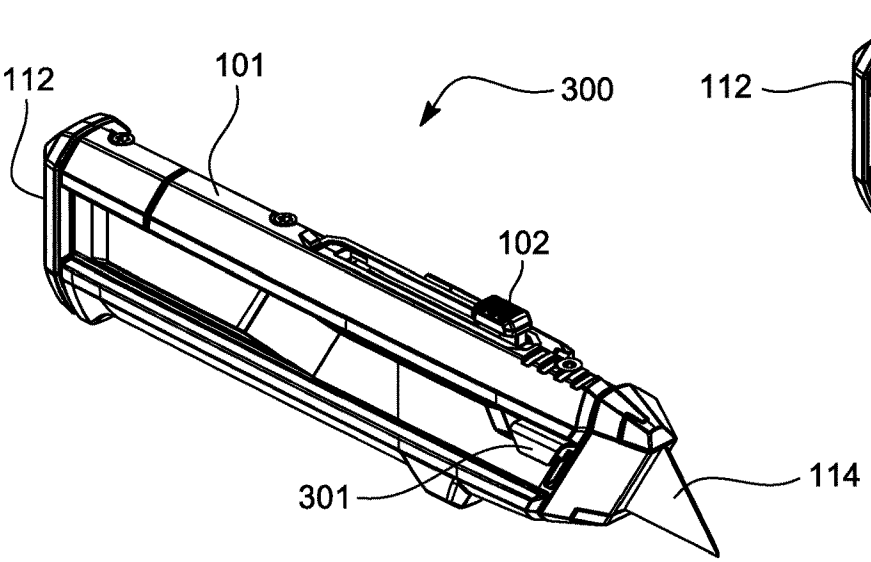
FIG. 3A shows an example reloadable knife with an inserted blade magazine and an extended blade.

FIG. 3A shows an example reloadable knife with an inserted blade magazine and an extended blade. The arrangement 300 includes the knife body 101, the back end 112 of the fully inserted blade magazine 110, the blade carriage slider button 102, the blade 114, and a blade release button 301.

In various embodiments, the blade 114 is deployed with the cutting edge facing downwards ready for application. The blade 114 is coupled with the blade carriage, as described later with respect to FIGS. 5A-5C, and is moved in and out of the knife body 101 via an opening or slit in the front end 103 of knife body 101. The blade carriage slider button 102 may be spring-loaded to allow the user to push the blade carriage slider button 102 down and return up again. There are simple locking notches or fingers in the carriage that lock it with respect to knife body 101 internally using complementary fingers or notches deployed within the knife body 101 interior. The blade carriage moves between two positions by sliding within the knife bode and parallel to the center axis connecting the front end 103 and back end 104 of the knife body 101. These internal blade carriage locks are placed at each end the blade carriage's travel, in two positions. A first (or back or retracted) position of the blade carriage travel is located closer to the back end 104 of the knife body 101 when the blade is fully retracted inside the knife body 101. A second (or forward or extended) position of the blade carriage travel is located closer to the front end 103 of the knife body, when the blade is fully extended outwards (ready for use).

In various embodiments, the blade release button 301 may be implemented in the form of a button, a lever, a handle, a slider, or any suitable mechanical input or actuator to effect a mechanical movement or change when pressed or otherwise actuated.

FIG. 3B shows an example reloadable knife with a released blade using a release mechanism. In various embodiments, in the arrangement 330 shown, the blade 114 has been released using blade release button 301 to be discarded. The blade carriage is now shown in the second position of its travel.

In various embodiments, the second position of the blade carriage may be used in two distinct operations. One is the blade extension and retraction operation, and the other one is the blade release or discard operation. In the blade retraction operation, the blade carriage is slid backwards towards the back end 104 of the knife body 101 to retract the blade 114 into the body for safe storage when the knife is not in use. In this operation, the blade carriage slider button 102 is depressed (pushed down and away from the top of knife body 101) by the user and held while pulling it back. When the blade carriage slider button 102 is released, the blade carriage is locked in its first position. To extend the knife out again, the opposite process is followed, namely, the blade carriage slider button 102 is depressed while pushing it forward towards the front end 103 of the knife body 101. At this time the blade carriage slider button 102 is released and locks in the second position of the blade carriage so the knife can be used securely and without moving with respect to the knife body 101 when cutting objects.

In various embodiments, as mentioned above, when the blade carriage is in its second (or forward) position, it may be used for the blade release or discard operation. In this operation, the user may depress or push the blade release button 301 towards the knife body 101 to force the blade carriage to disengage from the blade. At this point, the blade is laying inside the knife body 101 in a free and unattached manner and may be removed by pulling it out and discarding it. When the blade is discarded in this manner, the blade carriage button 102 may be depressed and pulled back again to engage and load a new blade from the operating or reloading compartment in the blade magazine 110. The next time the knife blade extension operation is employed a new or fresh blade is extended out. Hence, blade extension and blade release (discard) operations are both performed, at least partially, by using the blade carriage slider button 102. The blade release operation additionally incudes the use of the blade release button 301, as further described below with respect to FIGS. 5A-5C.

Figure 6:
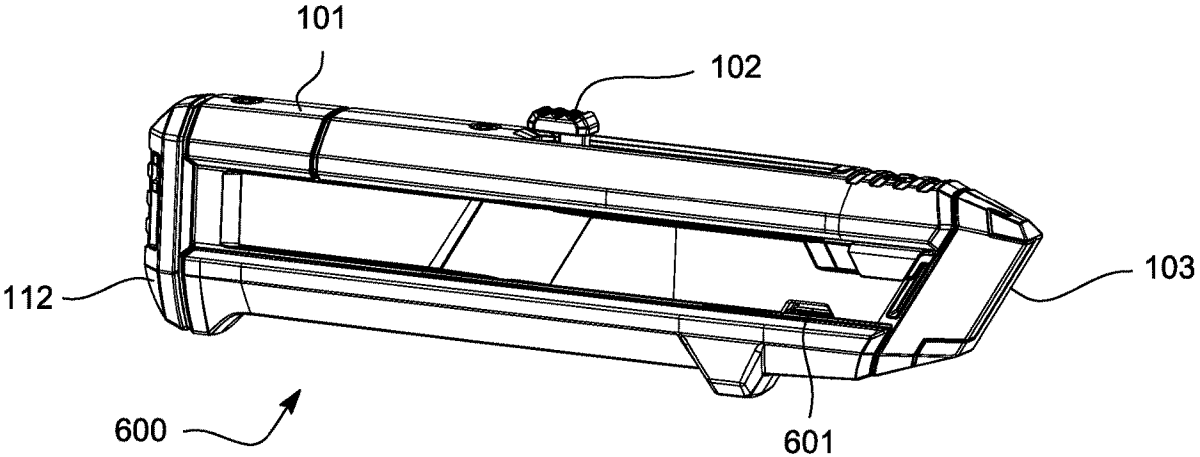
FIG. 6 shows an example viewing port to view a blade type loaded into a reloadable knife.

FIG. 3C shows the example reloadable knife of FIG. 6 in a state to reload a new blade. In various embodiments, the knife arrangement 360 includes the knife body 101, the blade magazine 110, the back end 112 of the blade magazine 110, the blade carriage slider button 102, the magazine lock lever 105, the lock pivot 107, the lock handle 108, the front end 103 of the knife body 101, and the released bladed 114.

In various embodiments, the blade release 301 (see FIG. 3A) when pressed, pushes the blade carriage away from the blade to disengage and detach it from the blade, which is then ready to be pulled out by the user unimpeded. If the reloading compartment of the blade magazine 110 is empty or if a different type of blade is desired, the lock handle 108 may be depressed to lift the lock lever 105 and release the blade magazine 110 and insert a new one with more blades or different types of blades.

Figure 4A:
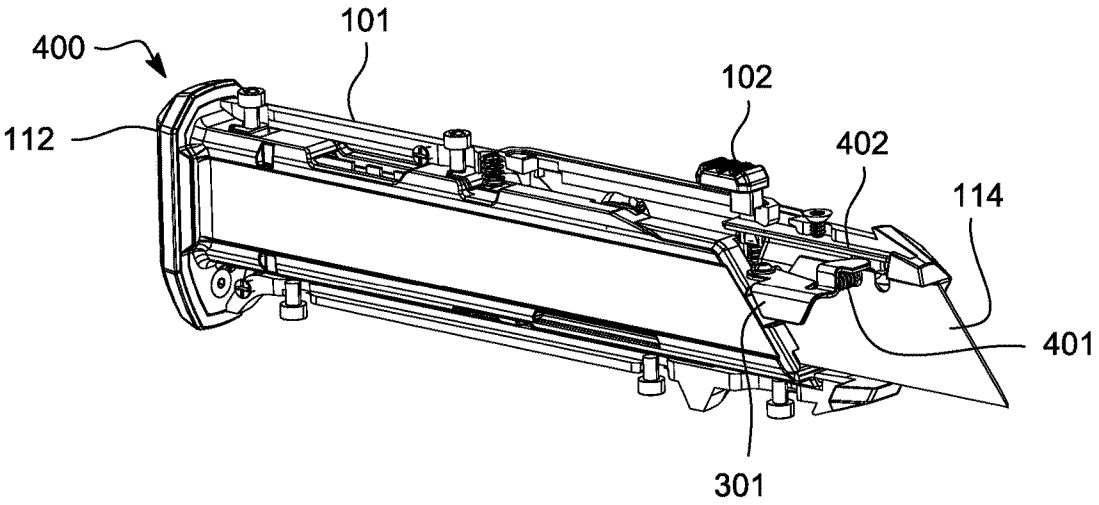
FIG. 4A shows an example internal structure of a blade release mechanism of the example reloadable knife of FIG. 3A before removal of released blade.

FIG. 4A shows an example internal structure of a blade release mechanism of the example reloadable knife of FIG. 3A before removal of released blade. In various embodiments, the knife configuration 400 includes knife body 101, blade carriage slider button 102, back end 112 of blade magazine 110, blade 114, blade release button 301, release button spring 401, and blade carriage 402.

In various embodiments, the blade release button 301, when pressed, pushes against the body of blade carriage 402 to disengage or detach it from the blade 114, hence releasing the blade 114 for removal by the user. The release button spring 401 returns the blade release button 301 to its original position when the user is not pressing the blade release button 301, allowing the blade carriage 402 to reengage the blade. As noted above, the blade release button 301 is functional when the blade carriage slider button 102 is in its second position and the blade 114 is extended out and can be removed.

In various embodiments, the blade release button 301 may be anchored or pivoted to the knife body 101 to be able to move with respect to knife body and push back the blade carriage 402 within the knife body when releasing the blade 114.

Figure 4B:
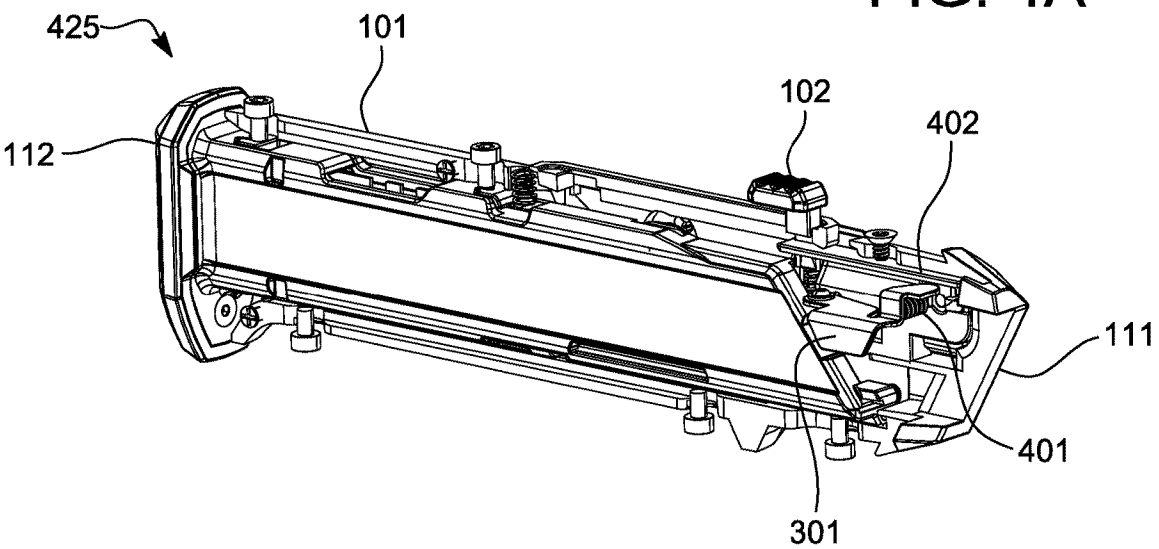
FIG. 4B shows the example internal structure of the blade release mechanism of the example reloadable knife of FIG. 3C after removal of released blade.

FIG. 4B shows the example internal structure of the blade release mechanism of the example reloadable knife of FIG. 3C after removal of released blade. In various embodiments, the knife configuration 425 includes knife body 101, blade carriage slider button 102, front end 111 of blade magazine 110, back end 112 of blade magazine 110, blade release button 301, release button spring 401, and blade carriage 402.

In various embodiments, the blade 114 may be held in place, in a direction substantially perpendicular to a sidewall of the knife body 101, using a magnet embedded in or otherwise coupled with the blade carriage 402. Pressing the blade release button 301 causes the magnet to be pushed away and detached from the blade 114 being held by the blade carriage 402. The blade is held in place in a direction along the longitudinal axis of the knife by protrusions that engage notches in the top (opposite the cutting edge) of the blade. The longitudinal axis of the knife body 101 is defined as an axis or line extending form the center of the front end 103 of the knife body 101 to the center of the back end 104 of the knife body 101. This is further described below with respect to FIGS. 5A-5C.

In other various embodiments, the blade 114 may be held in place by other blade holding mechanisms. In one embodiment, the blade 114 may be held in position using a spring. As noted herein, various types of springs may be used for this purpose, including spiral springs and leaf springs. In other embodiments, a retention lip on the blade carriage 402 may be pushed into position, for example, by rotation or by sliding, to hold the blade 114 in position (not shown in figure).

Figure 5B:
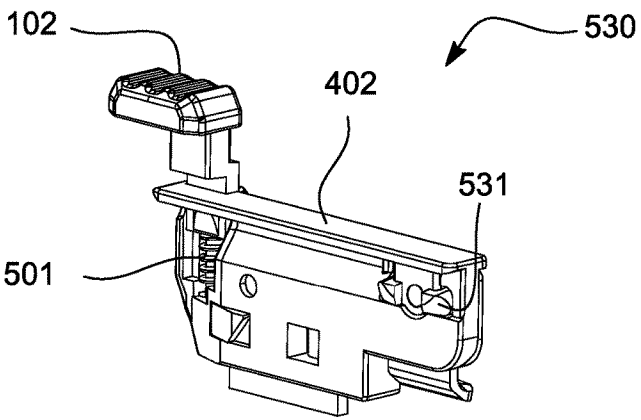
FIG. 5B shows the example detailed view of the blade carriage of FIG. 5A without an attached blade.
Figure 5C:
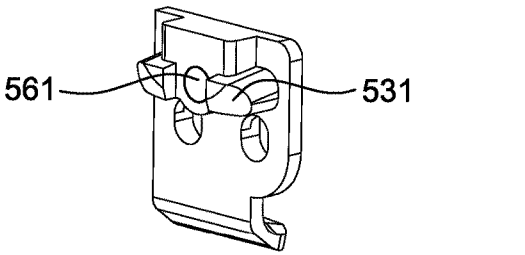
FIG. 5C shows an example blade attachment interface of the blade carriage of FIG. 5B.
Figure 5A:
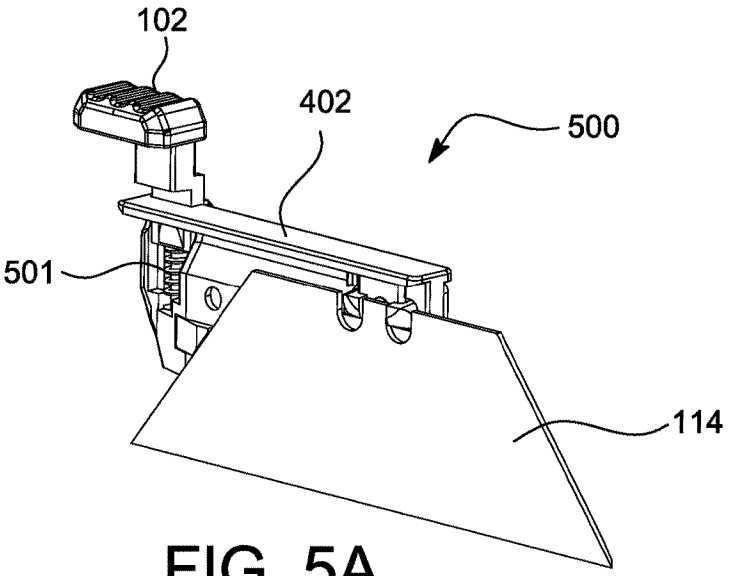
FIG. 5A shows an example detailed view of a blade carriage with an attached blade of a reloadable knife.

FIG. 5A shows an example detailed view of a blade carriage with an attached blade of a reloadable knife. In various embodiments, the blade carriage assembly 500, shown with the blade attached, includes the blade carriage slider button 102 attached to the body of the blade carriage 402 holding blade 114 in place within the knife body 101.

In various embodiments, the blade carriage slider button 102 moves the blade carriage 402 and the attached blade 114 back and forth along the longitudinal axis of the knife body 101. Standard blades available in the market include two or more notches on the top or back of the blade (opposite the cutting edge) that allows the blade to be engaged and held in place by the blade carriage for moving in and out of the knife body 101.

FIG. 5B shows the example detailed view of the blade carriage of FIG. 5A without an attached blade. In various embodiments, the blade carriage assembly 530, shown without the blade attached, includes the blade carriage slider button 102, the blade carriage 402, slider button spring 501, and one or more blade attachment protrusions 531.

In various embodiments, the slider button spring 501 pushes the blade carriage slider button 102 up (opposite the direction the cutting edge of the blade is facing) to lock it at the first position of the blade carriage slider button 102 (blade retracted) or at the second position of the blade carriage slider button 102 (blade extended).

In various embodiments, the blade attachment protrusions 531 go inside the corresponding notches of the blade 114 to keep the blade firmly in place when the blade carriage 402 is moving back and forth to retract or extend the blade 114, respectively.

FIG. 5C shows an example blade attachment interface of the blade carriage of FIG. 5B. In various embodiments, the blade attachment subassembly 560 includes the blade attachment protrusions 531, and a magnet 561.

In various embodiments, when a blade 114 is loaded into the knife, the blade 114 is attached to the blade carriage 402 via the blade attachment subassembly 560. The blade 114 is held in place by the magnet 561 simultaneously as the protrusions 531 engage the notches on the blade. This arrangement prevents the blade from moving up or down, left and right, or back and forth with respect to the carriage. These terms indicate a point in space in a three-dimensional (3D) space of X-Y-Z, and it is immaterial which direction is assigned to which term. So, for example, X-dimension may be assigned to "back and forth" and Z-dimension may be assigned to "up and down". The point is that the blade is held fixed in all directions in 3D space with respect to the knife body 101 and the blade carriage 402, unless it is moved by the blade carriage slider button 102 or is released using the blade release button 301, as described above.

In various embodiments, as mentioned previously, the blade carriage 402 performs two distinct functions in the reloadable knife in combination with the blade release button 301. The first function of the blade carriage 402 is to attach to a blade and move the blade back and forth along the longitudinal axis of the knife body. The blade may be attached to the blade carriage 402 using the magnet 561 and also further securing blade in place by inserting the protrusions 531 into the notches on top of the blade. Specifically, the blade carriage slider button 102 button may be depressed by the user to move the blade to the first or retracted position adjacent to the reloading compartment of the blade magazine 110. At this point the magnet 561 attracts and attaches the blade to the blade carriage 402, and the protrusions 531 are also inserted into the notches on top of the blade, completing the new blade loading process and also further securing the blade in place. The blade loading process is also assisted by a reloading compartment retainer spring, further described below with respect to FIG. 9. Next, the blade carriage 402 may be slid from the retracted position at the back end 104 of the knife body 101 to the extended position at the front end 103 of the knife body 101 or do the same in reverse (slide the blade carriage 402 from the extended position to the retracted position) as many times as needed, until the blade has to be changed due to wear or because a new blade type is desired. When a blade is attached to the blade carriage 402, another blade cannot attach to the blade carriage and stays in the reloading compartment to be loaded when the current working blade is discarded. This is because there is no physical room on the blade attachment subassembly 560 to carry more than one blade. The blade attachment subassembly 560 can accommodate no more than the thickness of a single blade.

The second function is to place the blade 114 in the extended position to be extracted by pressing the blade release button 301. More specifically, when the blade 114 is placed in the extended position by the blade carriage 402, the blade attachment subassembly 560 is placed in close proximity to the blade release button 301. When the blade release button 301 is pressed, it pushes away the blade attachment subassembly 560, including the magnet 561 and the protrusions 531, to separate and detach the blade from the blade carriage 402. At this point, the blade is detached from the blade attachment subassembly 560 and can be manually removed by the user. Now, to load a new blade, the blade carriage 402, which has no blade attached to it, can be moved back to the retracted position to attach to a new blade from the reloading compartment, as described above.

FIG. 6 shows an example viewing port to view a blade type loaded into a reloadable knife. In various embodiments, the knife configuration 600 includes the knife body 101, the blade carriage slider button 102, the front end 103 of the knife body 101, the back end 112 of the blade magazine 110, and a blade viewing window 601.

It is often desirable and helpful to the user to know or be able to check whether there is a blade in the knife and/or the type of blade that is currently loaded into the reloadable knife. In various embodiments, the viewing window 601 may be provided as a cut-out in the knife body 101 to allow viewing the existence and/or type of the blade 114 currently loaded in the knife. In other embodiments, the viewing window 601 may be smaller or larger in proportions than shown in this figure. In still other embodiments, the knife body 101 and/or the body of the blade magazine 110 may be made of transparent materials, such as transparent plastic, that makes the interior of the knife, including the existence and type of blades loaded, visible to the user. In other embodiments, the blade viewing window 601 may have different shapes, such as circular, rectangular, trapezoidal (as shown), oval, and the like. In other embodiments, the blade viewing port may include multiple ports or windows in succession that allow visibility into the interior of the knife and/or blade magazine 110. In some embodiments, the blade viewing window 601 may be placed adjacent to the front or reloading compartment of blade magazine 110, while in other embodiments, a second viewing window may be provided to allow the viewing of the back or storage compartment of blade magazine 110.

Figure 7:
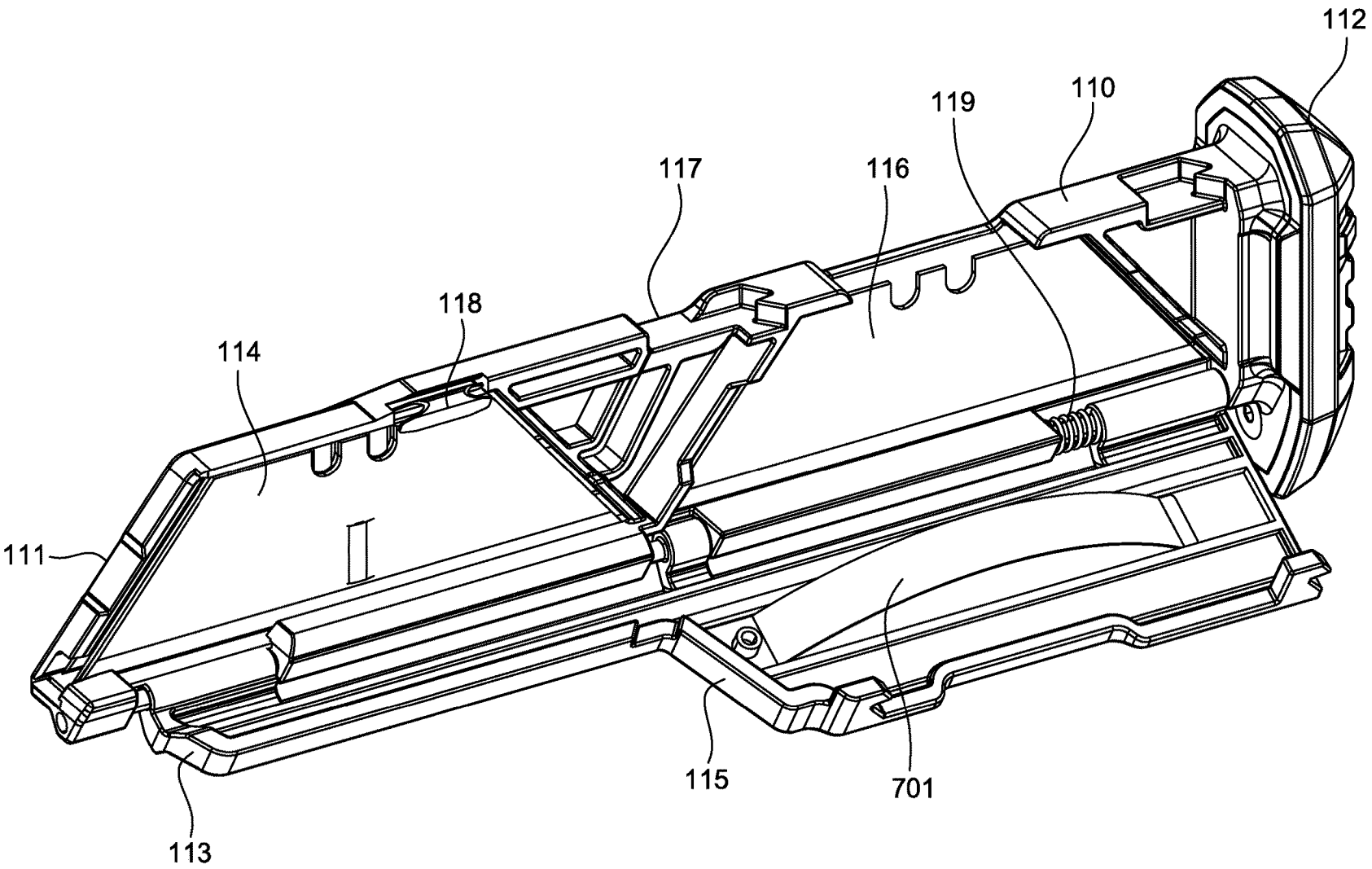
FIG. 7 shows an example internal structure of the example blade magazine of FIG. 1, including two blade compartments and a blade retention lip.

FIG. 7 shows an example internal structure of the example blade magazine of FIG. 1, including two blade compartments and a blade retention lip. In various embodiments, blade magazine 110 includes the front end 111, the back end 112, the blade reloading compartment partial lid 113, reloadable blades 114, storage compartment lid 115, spare blades 116, blade magazine lock notch 117, the blade retention lip 118, storage compartment lid spring 119, and storage compartment retention spring 701.

In various embodiments, storage compartment retention spring 701 may be a leaf spring that is used to push the spare blades 116 and keep them tightly enclosed in blade storage compartment, when the storage compartment lid 115 is closed. Additionally, the storage compartment retention spring 701 pushes or flips open the storage compartment lid 115 when the lid is unlatched. In some embodiments, the storage compartment lid 115 may be unlatched by sliding it forward (towards the front end 111 of blade magazine 110) to clear a catch or hook holding the lid closed. Once slid forward, the storage compartment retention spring 701 may push it open. This structure allows the one-handed operation of the blade magazine loading and unloading operation.

In various embodiments, a one-handed operation of the blade magazine 110 may be performed to load new blades or unload existing blades from the blade magazine compartments without dropping the blades or using and occupying both hands. This operation allows an efficient and quick handling of the blade magazine 110. One example of a one-handed operation is for the user to hold the blade magazine 110 with the storage compartment lid 115 facing up (opposite gravity's direction) and opening the storage compartment lid 115 by thumb and allow the storage compartment retention spring 701 push or flip open the storage compartment lid 115 while all blades stay in their place.

In various embodiments, the reloading compartment partial lid 113 is an integral extension of the storage compartment lid 115 and opens and closes when the storage compartment lid 115 opens and closes, respectively. In this embodiment, the reloading partial lid 113 and the storage compartment lid 115 are made together to be one piece. In other embodiments, the reloading compartment partial lid 113 is operated independently of the storage compartment lid 115 and opens and closes independently of the storage compartment lid 115. In these embodiments, the reloading compartment partial lid 113 may have a separate latch and opened and closed separately from the storage compartment lid 115. The one-handed operation may apply in both embodiments described above. The reloading compartment partial lid 113 partially covers the reloadable blades 114 to keep them within the blade reloading compartment. The reloading compartment partial lid 113 covers the bottom portion of the blades 114, from the cutting edge up, to prevent the blades from falling out. The blade retention lip 118 covers the top portion of the blade, opposite the cutting edge, thus, keeping the blades from tipping over from top to bottom or bottom to up and fall out of the blade reloading compartment.

In various embodiments, the blade retention lip 118 of the reloading compartment may be made of a flexible material, such as a springy steel tab. The blade retention lip 118 is connected to the reloading compartment on one side and is free on the other. The free end of the blade retention lip 118 stands at a short distance from the reloading (or operating) compartment. The blades may be pushed against the free end of the lip for insertion into place in the reloading compartment. The force of insertion of the blade depresses the free end of the lip a small distance and then the blade's top edge (opposite the cutting edge) clears the lip's free end and falls into place in the reloading compartment. In other embodiments, the blade retention lip 118 is non-flexible and rigid. The free end of the lip covers a small area of the reloading compartment, as shown in the figure, and blades are inserted into the reloading compartment by passing the blades under the free end of the lip into place. In this embodiment, the fee end of the lip serves as a rigid finger to hold in the blades and prevent them from falling out or leaning too far forward.

Figure 8:
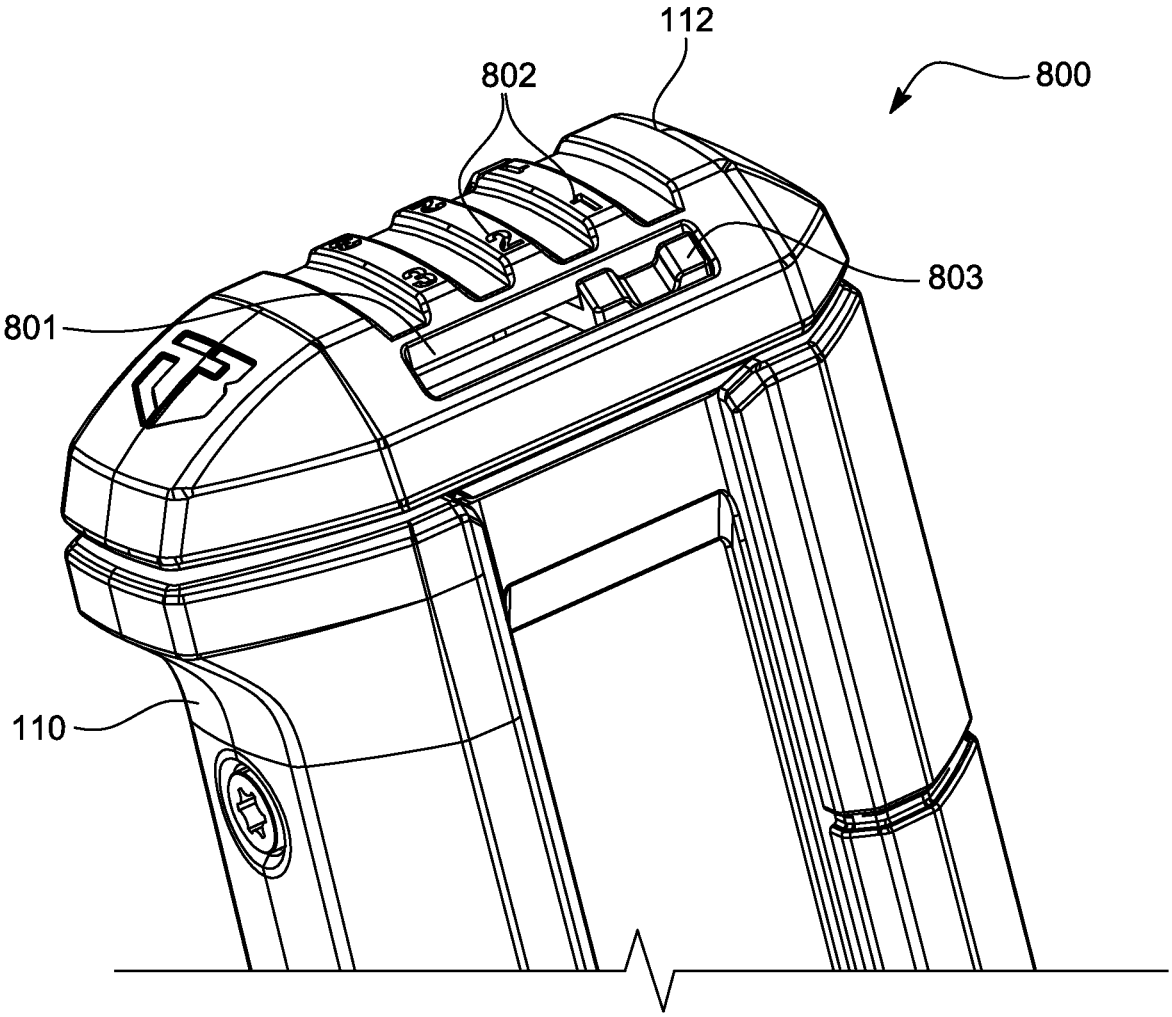
FIG. 8 shows an example bottom of an example blade magazine with a movable blade type indicator.

FIG. 8 shows an example bottom of an example blade magazine with a movable blade type indicator. The blade magazine end view 800 includes the back end 112 of the blade magazine 110, a marking slot 801, a number of identification markings 802, and a marking slider 803 deployed within the marking slot 801.

In various embodiments, the blade magazine 110 may contain various types of blades. Each compartment in the blade magazine 110 may include the same or different types of blades compared with the other compartment. An easy and quick visual indication of the types of blades loaded in a blade magazine 110 is desirable for the user. In some embodiments, the marking slot 801 has a number of identification markings 802, each of which indicates the particular type of blade inside the blade magazine 110. The marking slider 803 is moved by the user to a particular position in the marking slot 801 next to a particular identification marking 802. The location of the marking slider 803, thus indicates the type of blade currently loaded in blade magazine 110. In some embodiments, the markings are generic and each may be arbitrarily assigned to a particular blade type, while in other embodiments each of the markings may specifically identify a particular blade type by name or symbol. The markings may be color-coded, have different shapes, such as circles and triangles, alphabet, numbers, and the like. In some embodiments, there is one marking slot 801 for both compartments (that is, the reloading and storage compartments), while in other embodiments, two marking slots may be provided, one for each compartment. In the latter embodiments, the marking slots operate the same way for each competent as described above.

Figure 9:
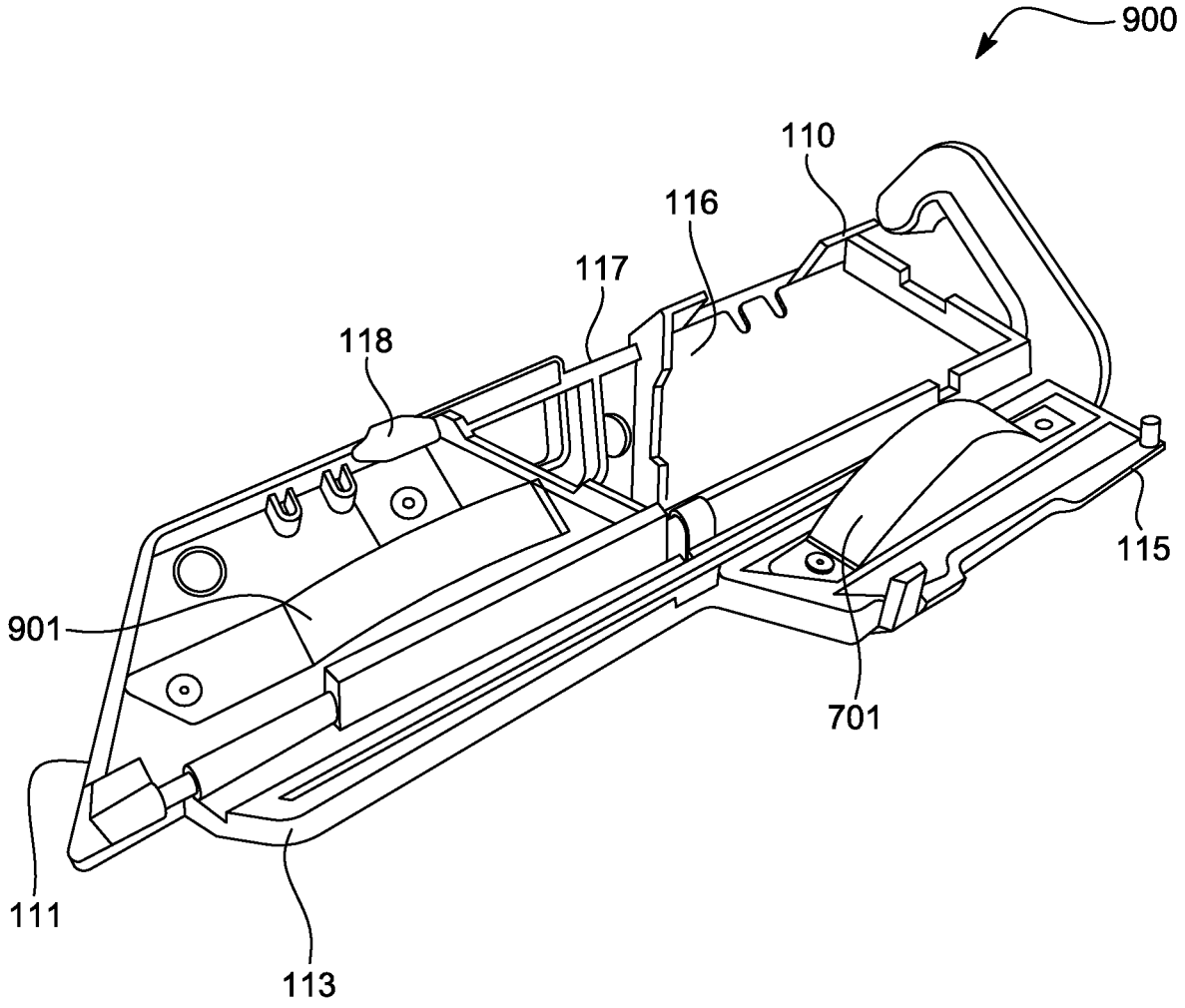
FIG. 9 shows the example internal structure of the example blade magazine of FIG. 7 including springs that help keep blades in the two blade compartments.

FIG. 9 shows the example internal structure of the example blade magazine of FIG. 7 including springs that help keep blades in the two blade compartments. In various embodiments, blade magazine configuration 900 includes the blade magazine 110, having the front end 111, the blade reloading compartment partial lid 113, storage compartment lid 115, spare blades 116, blade magazine lock notch 117, the blade retention lip 118, storage compartment retention spring 701, and reloading compartment retention spring 901.

In various embodiments, storage compartment retention spring 901 may be a leaf spring that is used to push the reloading blades 114 (not shown in this figure) and keep them tightly enclosed in blade storage compartment against the blade retention lip 118, when the reloading compartment partial lid 113 is closed. In some embodiments, as described above with respect to FIG. 7. the reloading compartment partial lid 113 is an integral part of the storage compartment lid 115, which may be unlatched by sliding it forward (towards the front end 111 of blade magazine 110) to clear a catch or hook holding the lid closed. Once slid forward, the storage compartment retention spring 701 may push it open. This structure allows the one-handed operation of the blade magazine loading and unloading operation, as described above.

In various embodiments, as noted above with respect to FIG. 7, the blade retention lip 118 of the reloading compartment may be made of a flexible material, such as a springy steel tab. The blade retention lip 118 is connected to the reloading compartment on one side and is free on the other. The free end of the blade retention lip 118 stands at a short distance from the reloading (or operating) compartment. The blades may be pushed against the free end of the lip for insertion into place in the reloading compartment. The force of insertion of the blade depresses the free end of the lip a small distance and then the blade's top edge (opposite the cutting edge) clears the lip's free end and falls into place in the reloading compartment. In other embodiments, the blade retention lip 118 is non-flexible and rigid. The free end of the lip covers a small area of the reloading compartment, as shown in the figure, and blades are inserted into the reloading compartment by passing the blades under the free end of the lip into place. In this embodiment, the fee end of the lip serves as a rigid finger to hold in the blades and prevent them from falling out or leaning too far forward. In any of the above embodiments, the reloading compartment retention spring 901 pushes the reloading compartment blades against the blade retention lip 118 to keep the blades in place without falling out. The blades in the reloading compartment may be extracted one by one by sliding them out from under the blade retention lip 118. The reloading compartment retention spring 901 also assists in loading a fresh blade from the reloading compartment onto the blade attachment subassembly 560 (see FIG. 5C) by pushing the blades in the compartment outwards to be loaded onto the blade attachment subassembly when it is not already loaded with an existing blade.

It will be understood that unless explicitly stated or specified, the steps described in a process are not ordered and may not necessarily be performed or occur in the order described or depicted. For example, a step A in a process described prior to a step B in the same process, may actually be performed after step B. In other words, a collection of steps in a process for achieving an end-result may occur in any order unless otherwise stated.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." It is further understood that any phrase of the form "A/B" shall mean any one of "A", "B", "A or B", or "A and B". This construct includes the phrase "and/or" itself.

The above specification, examples, and data provide a complete description of the manufacture and use of the claimed invention. Since many embodiments of the claimed invention can be made without departing from the spirit and scope of the disclosure, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

What is claimed is:

1. A reloadable utility knife comprising:

a hollow knife body having a front end and a back end;

a back entry at the back end of the knife body to receive a blade magazine adapted to be locked within the knife body, wherein the blade magazine includes at least one blade reloading compartment to contain a plurality of blades, wherein the at least one blade reloading compartment includes a blade retention lip to keep the plurality of blades inside the at least one blade reloading compartment;

a blade magazine lock having a lock lever and a lock handle;

a notch to receive the lock lever to lock the blade magazine in the knife body; and a blade carriage deployed within the knife body to engage a working blade from the blade magazine to slide out the working blade for use or retract the working blade for storage.

2. The reloadable utility knife of claim 1, wherein the blade magazine further comprises a blade storage compartment to receive a plurality of spare blades.

3. The reloadable utility knife of claim 2, wherein the blade storage compartment has a storage compartment lid to cover the plurality of spare blades.

4. The reloadable utility knife of claim 1, further comprising a magazine extraction spring.

5. The reloadable utility knife of claim 4, wherein the magazine extraction spring couples to a front end of the blade magazine via a plunger.

6. The reloadable utility knife of claim 1, wherein the knife body includes a viewing window to view the plurality of blades in the blade reloading compartment.

* * * * *